United States Patent [19]

Violet

[11] 3,974,996

[45] Aug. 17, 1976

[54] CANDLE MOLD

[75] Inventor: John L. Violet, Fallbrook, Calif.

[73] Assignee: General Craft Supplies, Fallbrook, Calif.

[22] Filed: Dec. 16, 1974

[21] Appl. No.: 532,839

[52] U.S. Cl. ..... 249/112; 249/164; 249/173; 425/803

[51] Int. Cl.[2] ..... B28B 7/36

[58] Field of Search ..... 425/803, 440, DIG. 44, 425/DIG. 124; 249/173, 112, 164, 48, 127, 187

[56] References Cited

UNITED STATES PATENTS

| | | | |
|---|---|---|---|
| 26,429 | 12/1859 | Halvorson | 425/803 |
| 1,762,440 | 6/1930 | Howe | 249/173 |
| 2,735,153 | 2/1956 | Chanlund | 425/440 X |
| 3,679,167 | 7/1972 | Jupiter et al. | 249/173 |
| 3,724,982 | 4/1973 | Davis | 425/803 |
| 3,881,682 | 5/1975 | Kin | 249/164 X |

*Primary Examiner*—Richard B. Lazarus
*Attorney, Agent, or Firm*—Gausewitz, Carr & Rothenberg

[57] ABSTRACT

A mold for candles having a three dimensional surface pattern is formed of a split elongated shell having juxtaposed edges detachably connected together. Lining the shell is a split sleeve having an inner surface bearing the selected three dimensional pattern and longitudinal edges in close face to face juxtaposition. The sleeve is formed of silicone rubber initially formed in its final molding configuration so that after molding, the shell may be removed from the sleeve and the split sleeve may be peeled back from the molded article, resiliently returning to its mold configuration when the article is removed. Flexibility of the sleeve permits it to be removed from undercut surface of the pattern.

7 Claims, 8 Drawing Figures

FIG. 1.
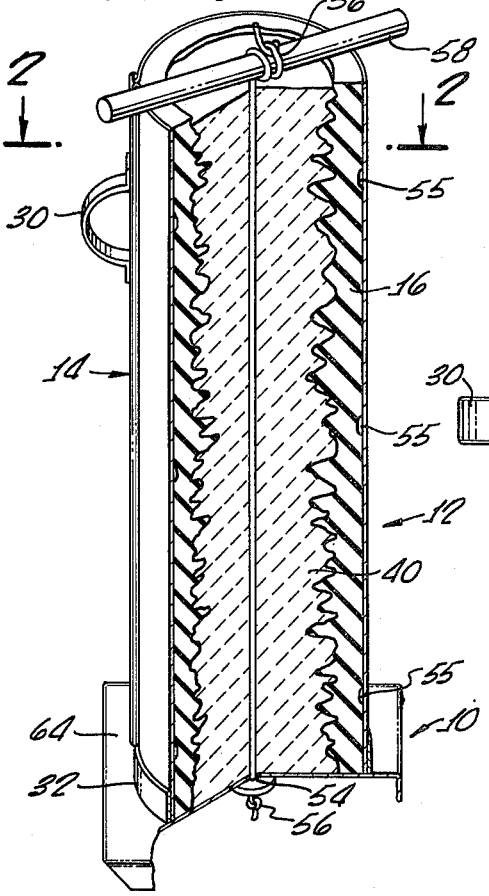
FIG. 2.
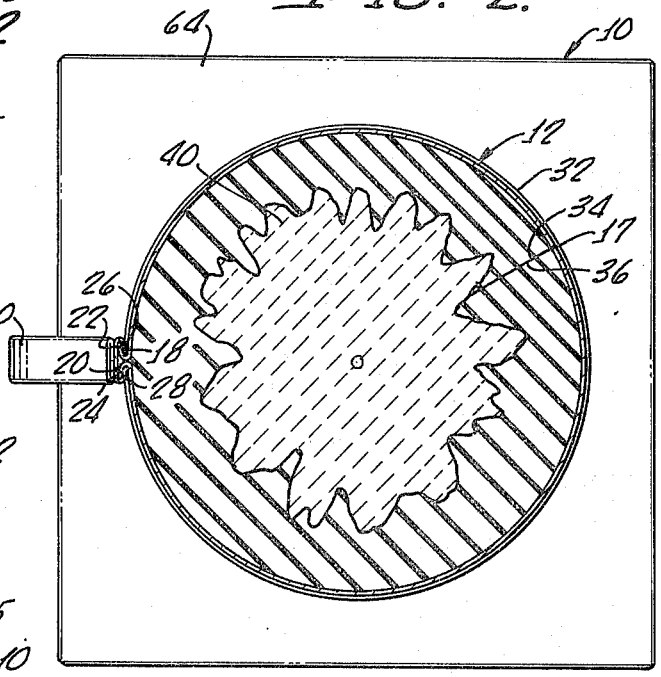
FIG. 3.
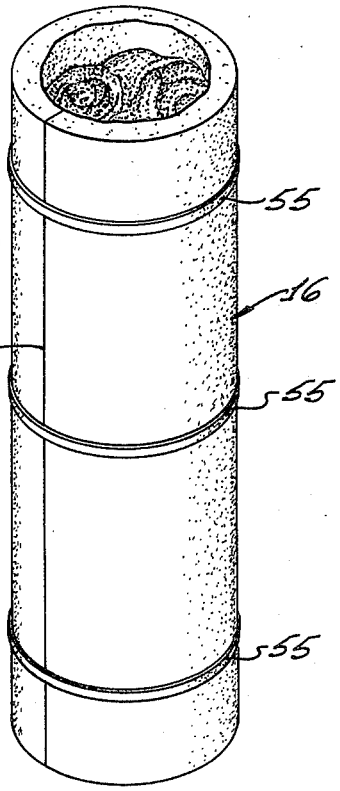
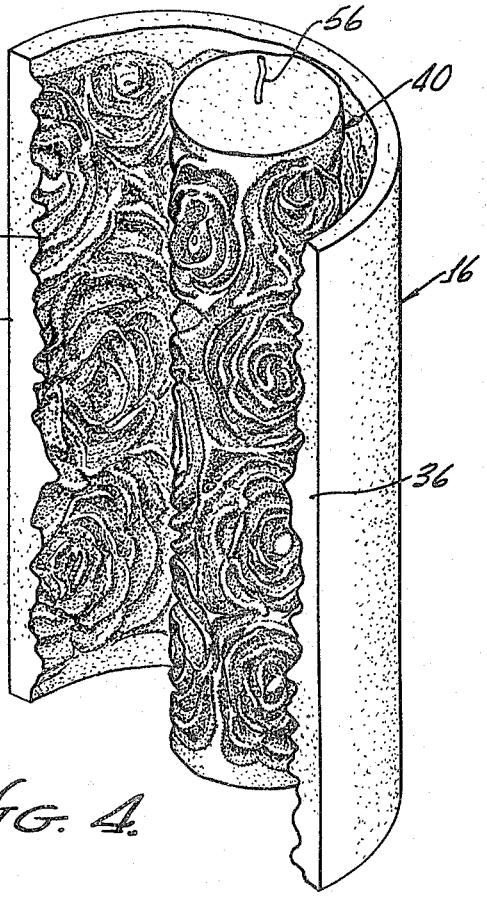
FIG. 4.

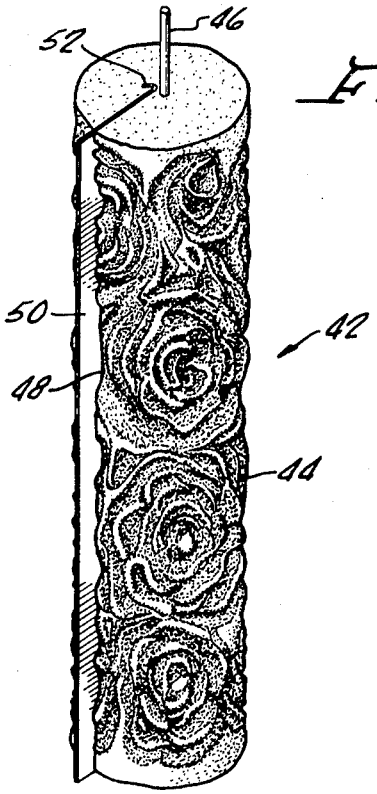
FIG. 5.
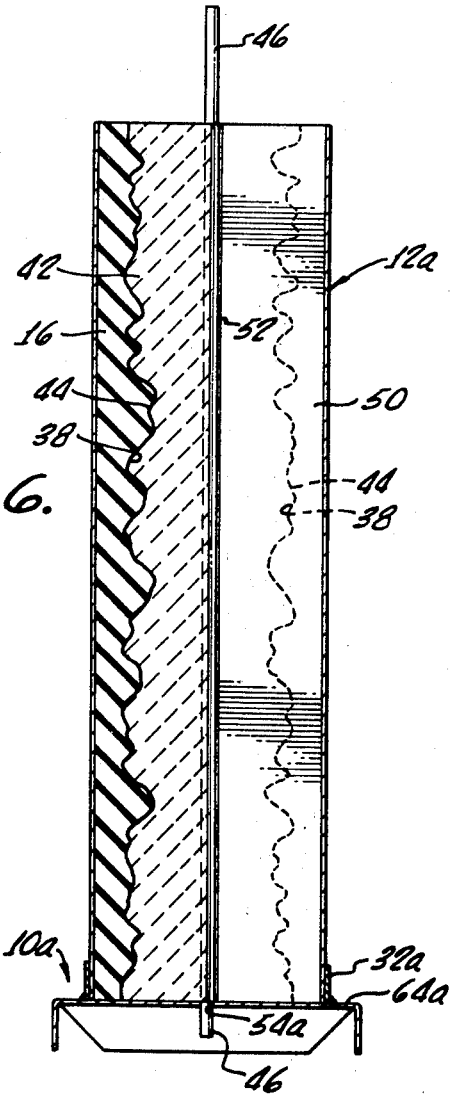
FIG. 6.
FIG. 7.
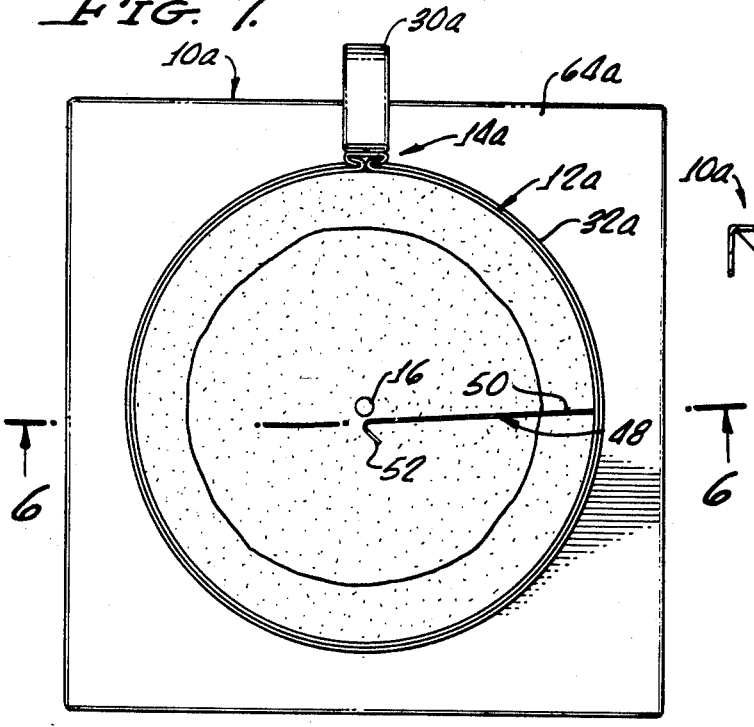
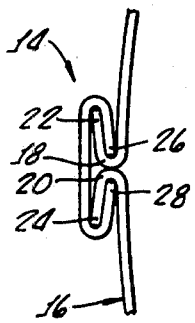
FIG. 8.

CANDLE MOLD

BACKGROUND OF THE INVENTION

In the molding of articles of various types and in the molding of decorative candles in particular, the nature and extent of three dimensional surface patterns on the article have generally been limited by mold construction techniques, costs of complex molding equipment, and complexity of sectional molds. Molding of decorative candles having intricately designed patterns on their exterior surfaces has been carried out by molds formed of two, three or more sections that are detachably connected together to form a complete continuous mold cavity. Such sectional molds are shown in U.S. Patents to Davis 3,724,982 and Lerman et al 3,622,117. Generally, where such rigid multipart molds are employed, the molded article is formed with a number of parting lines equal to the number of mold parts. These parting lines result from the difficulty or economic impracticality of obtaining precisely mating and fitting surfaces of the mold parts. Molten mold material generally flows partly into the joint between the mold parts to cause these parting lines. It is difficult, expensive and time consuming to remove the lines and, particularly for patterns of intricate configurations, the resulting article may be unacceptable.

Even beyond the problem of parting lines and the difficulty of their removal, certain intricate configurations and, particularly, certain types of undercut surfaces cannot possibly be formed by conventional rigid multi-part mold constructions. Thus, as shown, for example, in U.S. Pat. No. 3,815,863 to Andeweg, molds of desired configurations are formed by inflatable elements which take the desired shape upon inflation. Although the problem of parting lines is minimized, the number, variety and intricacy of pattern configurations are significantly limited by the relatively small number of shapes available from an inflatable membrane.

Accordingly, it is an object of the present invention to provide for the molding of articles of intricate three dimensional patterns by methods and apparatus that avoid or minimize the above identified problems and disadvantages.

SUMMARY OF THE INVENTION

In carrying out principles of the present invention in accordance with a preferred embodiment thereof, a mold is made with a detachable shell and lined with a split sleeve formed of a flexible and resilient elastomeric material having a configuration memory, whereby the split sleeve may be readily peeled back from the molded article and resiliently detached from complexly shaped patterns thereof, but will readily and rapidly return to its preferred mold configuration, ready for molding another article. The sleeve is formed on a master mandrel as an integral continuous split tube that continuously circumscribes the mandrel. The longitudinal slit of the sleeve provides closely juxtaposed contiguous edge surfaces that may be moved away from each other to allow the sleeve to be peeled back from and removed from the master mandrel and, in a like manner, peeled back from and removed from articles molded therein.

BRIEF DESCRIPTION OF THE DRAWINGS

FIG. 1 is a perspective view with parts broken away of a mold constructed in accordance with principles of the present invention;

FIG. 2 is a sectional view of the mold of FIG. 1 taken on line 2—2 of FIG. 1;

FIG. 3 is a perspective view of the liner of the mold of FIG. 1 in its unstressed mold configuration;

FIG. 4 is a perspective view of the mold liner being peeled back from a molded article;

FIG. 5 is a perspective view of a master mandrel for forming the liner;

FIG. 6 is a sectional view of apparatus for forming the mold liner;

FIG. 7 is a top plan view of the apparatus of FIG. 6; and

FIG. 8 is an enlarged detail of the shell retainer.

DETAILED DESCRIPTION

As illustrated in FIG. 1, a mold embodying principles of the present invention includes four basic elements; a base and socket member 10, a mold shell 12, a sliding shell retainer 14 and a mold liner 16. The mold shell is formed of a thin wall resilient sheet material, such as a resilient plastic or metal sheet having a generally tubular configuration open at both top and bottom. In a preferred embodiment the shell is in the form of a split hollow right circular cylinder having juxtaposed end portions 18, 20 including reversely bent flanges 22, 24 (FIG. 2). The end portions and flanges are continuous from top to bottom of the shell. To retain the shell in the illustrated mold configuration, the slidable retainer 14 is provided, having a length slightly less than the length of the tubular shell and having a channel or C-shaped cross section with inwardly directed legs 26, 28 that are respectively interengaged with the reversely bent flanges 22, 24 of end portions 18, 20. A handle 30 is fixed to the slidable retainer 14 to facilitate manipulation of the retainer to slide it into locking engagement with the end portion of the shell and to slidably remove it therefrom.

Cooperating with the slidable retainer 14 to hold the shell 12 in mold configuration and further, to support the remaining elements of the mold apparatus, is the base 10 which is provided with a fixed continuous upstanding flange 32 that defines a circular socket to slidably and detachably receive the lower open end of the shell 12. As can be seen in FIG. 1, slidable retainer 14 extends from the upper open end of the shell 12 to the upper edge of the flange 32 and thus has a length somewhat less than the total length of the mold shell 12.

The split liner or sleeve 16 has a normal unstressed mold configuration as illustrated in FIGS. 1, 2 and 3, for example, which defines an inner mold cavity that is contained within the outer mold cavity. The latter is defined internally of and by the interior surface of the mold shell 12. The internal surface of mold shell 12 is substantially smooth and free of obstruction and the external surface of sleeve 16 is likewise relatively smooth and free of obstruction to provide a close and intimate contact throughout its area with the internal surface of shell 12.

Split sleeve or liner 16 is formed of an integral resilient and flexible elastomeric material, more particularly described below. The material is of the type having a "memory" so that it may be resiliently and elastically deformed and distorted to a significant extent but will, nevertheless, return to its initial configuration upon release of deforming and distorting forces. Such initial configuration of the liner of the described mold is that shown in FIG. 3, in which the longitudinally extending slit 17 of the liner defines mating edges 34, 36 (see FIG. 4) that are normally (in unstressed condition) in close face to face contiguity.

The inner surface 38 of liner 16 has formed therein the preselected three dimensional pattern that is to be impressed upon an article that will be formed in this mold. The three dimensional pattern 38 may be complex, intricate and may include undercut surfaces. It is possible to include such undercut surfaces in the pattern because of the elasticity and resilience of the material of which the liner is made and, further, because of the manner in which it is arranged to be peeled back from a circumscribed molded article.

Such peeling back of the liner from a completed article is illustrated in FIG. 4 which shows a candle 40 formed of a liquid molding material, such as hot wax, that has been poured into and solidified within the mold. Both the solidified candle and liner are removed together from the mold shell, as shown in FIG. 4. To detach the candle from the liner, the mating liner edges 34, 36 are gently moved away from each other and simultaneously moved away from the candle. The flexible liner is elastically and resiliently deformed and slowly peeled back and away from the completed article. As each portion of the mold liner begins to move away from its mating surface on the completed article, it moves in a nearly outwardly radial direction. Almost no relative sliding motion is required between the liner and the molded article. Elasticity of the liner allows it to stretch and deform as it is pulled away from the molded article and thus, it will release and be readily detached from surfaces that are undercut.

There are many elastomeric materials having sufficient flexibility, resilience, elasticity and configuration memory for use in accordance with principles of the present invention. Such materials are well known and readily available. One such elastomer that has been found to be useful and is preferred in practice of the present invention is "RTV", a silicone rubber, made by the General Electric Co. of Schenectady, New York, and described on p. 766 of *The Condensed Chemical Dictionary*, Eighth Edition. RTV rubbers and hardners therefor suitable for practice of the present invention, are available from General Supplies Co. of Fallbrook, Calif. as No. 161-RTV-280.

A significant feature of the mold of FIGS. 1 through 4 is the fact that it produces little or no visible parting lines. This is due, in part, to the manner in which the mold liner is formed and to the close mating and juxtaposition of longitudinally extending edges 34, 36 which fit precisely one upon the other. To achieve this end, the mold liner 16 is formed as an integral continuous, flexibly elastic split tube by apparatus illustrated in FIGS. 5–7. A master mandrel 42 is formed having a rigid construction, either hollow or solid, and having an external surface 44 in which is formed the three dimensional pattern that is to be formed upon the outer surface of the molded end article. Fixedly positioned within the mandrel is a rigid rod 46 extending beyond both ends of the mandrel body. A thin flat sheet 48, of metal for example, is also fixed in the mandrel, extending longitudinally from end to end of the mandrel and extending radially from the center of the mandrel outwardly thereof to form a sleeve divider strip 50. The radially inner edge of sheet 48 is bent as at 52 to enhance its connection with the mandrel body. Strip 50 has a radial extent (e.g. the sheet 48 projects out of the mandrel body) for a distance equal to the thickness of the liner 16.

The mandrel is employed with mold parts comprising a base 10*a*,12*a* 12a and a retainer 14*a*, all of which are identical to the corresponding candle mold parts 10, 12, panel 14. Rod 46, at the lower end of the mandrel, projects through a wick receiving hole 54*a* formed in the center of the base socket 82*a* and thereby centrally positions the mandrel within the mold shell 12*a* to provide an annular mold space of uniform thickness between the interior surface of the shell 12*a* and the patterned exterior face of the mandrel. The outer edge of divider strip 50 contacts the shell 12*a* to ensure a division of adjacent edges of the liner that is to be molded thereon. If deemed necessary or desirable, a quick release sheet such as a thin film of plastic or other conventional mold release material is used to line or coat the interior surface of shell 12*a*. This facilitates detachment of the former liner from shell 12*a*.

The liquid silicone rubber from which the liner 16 is formed is then mixed and poured or otherwise emplaced within the annular mold space between the mandrel and shell 12*a*, and allowed to cure at room temperature. The liner thus cures to its final and preferred mold configuration as an integral tubular sleeve of flexible and elastic material that is split at divider strip 50. The shell, liner and mandrel are then removed from base 10*a* and the shell 12*a* is then removed from the cured liner. Now the two edges 34, 36 of the line slit may be moved away from each other and the liner is gently peeled back and away from the master mandrel, just as it is peeled back and away from a formed molded article that will be thereafter formed within the sleeve 16. When the liner is completely detached from the mandrel and allowed to resume an unstressed condition, it will assume the mold configuration illustrated in FIGS. 1, 2 and 3 in which the edges 34, 36 mate precisely and almost in contact with each other.

In use of the described mold, the resilient split shell 12 has its end portions 18, 20 secured to each other by slidable retainer 14. The mold liner 16 is slidably inserted into the outer cavity defined by the inner surface of the shell 12. The pre-assembly of shell 12 retainer 14 and liner 16 is inserted into the socket formed by flanges 32 of base 10. Before inserting the liner into its shell one or more common rubber bands 55 are stretched to completely encircle the liner at axially spaced points thereof. These bands, which remain in place during the molding, ensure holding the split liner in circularly closed position, pressing the side edges 34, 36 against each other, and also ensure a snug fit between the exterior surface of the liner and the interior surface of the shell 12.

A wick 56 is secured by conventional means, such as knot and apertured sealing washer, at the lower side of an aperture 54 formed in the base 10 and extends through this aperture, through the interior of the liner 16 and is secured to a rod 58 that rests upon the upper open end of the shell 12 and liner 16. Now the mold material, such as melted wax, is poured into the inner cavity defined by liner 16 and thereupon flows into intimate contact with the pattern formed on the inner surface of the liner. Preferably the mold is initially filled with a "plug" of hot wax to a depth of about one half inch. After this plug has cooled the remainder of the wax is poured. After the mold material has solidified. the wick is severed at the lower side of base 10. The assembly of shell 12, retainer 14 and liner 16, together with the molded article and wick are removed from the base and the wick is detached from the rod 58 which is then removed.

Retainer 14 is slidably moved along the end portions 18, 20 of the mold shell to release these end portions and the shell is then resiliently opened. This opening of the shell requires but a small amount of motion to insure release of the relatively smooth outer surface of the liner 16 from the inner surface and relatively smooth inner surface of the shell. Thereupon, the liner 16, (and rubber bands, if used) together with the molded article therein is slidably removed from the shell. As illustrated in FIG. 4, the mating edges 34, 36 of the liner are moved slowly and carefully away from each other, thereby readily and simply removing the liner from the molded article. Upon removal of the liner from the molded article and release of restraining forces upon the liner, its configuration memory causes it to return to its mold configuration as illustrated in FIGS. 1, 2 and 3.

Although the illustrated mold is disclosed as being adapted for the molding of articles of right circular cylindrical configuration, it will be readily understood that the mold may easily be formed for making articles of cylindrical shapes other than of circular sections and also for making articles of non-cylindrical elongated shapes including tapered candles and devices having varying and/or otherwise irregular cross sections. For making tapered candles, for example, the mold may still employ a shell 12 of a right circular cylindrical configuration defining an outer cavity of right circular cylindrical shape. The liner 16 for such a tapered configuration will have a tapering interior surface formed with a desired pattern and a relatively smooth outer right circular cylindrical surface to conform to the inner surface of the shell 12. Thus, it will be seen that without changing the configuration of the shell 12, but merely by changing relative wall thickness at different portions of the liner 16, different configurations and variations of cross section of a molded article can be achieved, all benefiting by the simplified elastic, peeling back of the mold liner 16 from intricately formed article surfaces.

Although a preferred form of shell 12 is illustrated as comprising a split sleeve and slidable retainer, it will be readily appreciated that the shell 12 can be made in two or more parts detachably connected together by bolts, clamps or the like, since no parting line on the finished article will be caused by joints between different parts of the shell 12. The only joint to which the finished article is subjected is that formed by the precisely mating surfaces 34, 36. These surfaces provide a precision interfit and thus, a greatly minimized parting line because they are formed by the thin divider strip 50. Further the hollow liner sleeve may be made with its pattern formed on an exterior surface thereof to cooperate with a surrounding shell spaced from the liner to mold hollow articles having a pattern formed on an inner concave surface.

The foregoing detailed description is to be clearly understood as given by way of illustration and example only, the spirit and scope of this invention being limited solely by the appended claims.

I claim:

1. A mold for making articles having a three dimensional pattern on an external surface thereof, said mold comprising a mold shell having an interior surface defining an outer mold cavity, said shell including means for relatively displacing parts of the shell to enable detachment of the shell from the contents of said outer mold cavity, a resiliently and elastically deformable liner within said cavity, said liner comprising a hollow sleeve having an exterior surface adapted to mate in close juxtaposition to the interior surface of said shell and having an inner surface formed with a three dimensional pattern defining an inner mold cavity, said liner having a longitudinal slit extending entirely through the liner from one end thereof to the other to define contiguous mating edges, said liner being formed of a stretchable elastomeric material that allows the liner to stretch as it is pulled away from a molded article thereby to facilitate release from an article having a three dimensional surface pattern, and means circumscribing said liner and interposed between the liner and the shell for holding the sides of the sleeve together and snugly fitting the liner within the shell.

2. The mold of claim 1 wherein said shell comprises an integral thin wall elongated hollow body substantially completely circumscribing said liner and having first and second closely juxtaposed end portions, said thin wall body extending continuously about said liner from one of said end portions to the other, and retaining means for detachably holding said end portions together throughout substantially the entire length of said body, whereby said retaining means may be removed from said end portions and the end portions of said body may be moved away from each other against the resilience of the body to detach the shell from the mold liner, and whereby after the shell has been detached from the mold liner, the edges of the latter may be similarly moved away from each other to peel the flexible and resilient sleeve from an article that has been molded within the inner cavity.

3. The mold of claim 2 wherein said means for detachably closing said one end of said inner mold cavity comprises a base member, a continuous flange upstanding from said base member to define a shell receiving socket, said socket being constructed and arranged to slidably and snugly receive said one end of said mold shell.

4. The mold of claim 3 wherein the end portions of said shell are each formed with a reversely bent flange extending substantially the full length of the shell and wherein said retaining means for detachably connecting said end portions comprises an elongated channel shaped member having inwardly directed legs, each adapted to be received respectively in a respective one of said reversely bent end portion flanges.

5. The mold of claim 1 wherein said liner is formed of a stretchable rubber like material having a normal unstressed configuration that substantially defines a completely circumscribed mold cavity within the liner, said material having sufficient elasticity to enable the liner to be peeled away from a molded article and to be elastically deformed and stretched as it is pulled away from undercut surfaces of said molded article, and said material having a configuration memory whereby it returns to said normal unstressed configuration upon release of deforming forces exerted thereon.

6. A liner for a mold adapted to be used in molding patterned articles, said liner comprising an elongated hollow sleeve formed of an integral thin walled body of elastomeric material, said elastomeric material being resiliently deformable and stretchable and having a configuration memory whereby the material returns to an original configuration after elastic deformation thereof, said sleeve having first and second ends and first and second side edges, said edges extending from end to end of the sleeve and being in substantial face to face contiguity with each other in normal unstressed condition of the liner, said liner having interior and exterior surfaces, one of said surfaces being a substantially smooth one, the others of said surfaces being formed with a preselected three dimensional pattern that is to be formed on an article to be molded therein, and elastic means circumscribing the hollow sleeve for resiliently pressing said side edges against each other and adapted to be interposed between said mold and liner to snugly fit the liner within the mold.

7. A candle mold comprising an elongated longitudinally split integral mold shell formed of a thin wall resilient material and having mutually adjacent longitudinally extending edge portions, means for detachably connecting said edge portions to each other in mutual juxtaposition to define a cavity, a base having a socket adapted to receive one end of said shell and close one end of the cavity defined by and within the shell, a split sleeve lining said shell, said sleeve having a relatively smooth exterior surface in close contiguity with an inner surface of the shell throughout the length of the cavity defined by the shell, and having an inner surface formed with a preselected three dimensional pattern to be impressed upon an article to be molded therein, said sleeve being formed of a stretchable silicone rubber material having a normal configuration that defines a completely enclosed cavity within the sleeve, opposite sides of said split of said sleeve being in close mutual juxtaposition in said normal configuration, and means circumscribing said sleeve and interposed between the sleeve and the shell for both holding the sides of the sleeve together and snugly fitting the liner within the shell.

* * * * *

UNITED STATES PATENT AND TRADEMARK OFFICE

CERTIFICATE OF CORRECTION

PATENT NO. : 3,974,996

DATED : August 17, 1976

INVENTOR(S) : John L. Violet

It is certified that error appears in the above-identified patent and that said Letters Patent are hereby corrected as shown below:

Col. 3, line 40: Put quotes around the word "memory";

Col. 4, line 8: After "10a" delete "12a" the second time it appears and before first appearance of "12a" insert ---shell---;

Col. 4, line 23: Change "former" to ---formed---;

Col. 5, line 1: Put quotes around word "plug";

Col. 5, line 22: Put quotes around word "memory".

Signed and Sealed this

Sixteenth Day of November 1976

[SEAL]

*Attest:*

RUTH C. MASON
*Attesting Officer*

C. MARSHALL DANN
*Commissioner of Patents and Trademarks*